United States Patent [19]

Rijnders et al.

[11] 3,979,622

[45] Sept. 7, 1976

[54] HEADLIGHT AND INCANDESCENT LAMP FOR ANTI-DAZZLE BEAM

[75] Inventors: Johannes Rijnders, Boxtel; Harry William Jelle Iedema, The Hague, both of Netherlands

[73] Assignee: U.S. Philips Corporation, New York, N.Y.

[22] Filed: May 1, 1974

[21] Appl. No.: 465,887

[30] Foreign Application Priority Data

May 1, 1973 Netherlands ..... 7306006

[52] U.S. Cl. ..... 313/117; 240/41 SB; 240/41 SC; 313/239; 313/315; 313/326

[51] Int. Cl.[2] ..... H01K 1/26; H01K 1/32; H01K 7/02

[58] Field of Search ..... 313/113–117, 313/326, 222, 239–242, 315, 316; 240/41.4 R, 41.4 D, 41 SB, 41 SC

[56] References Cited

UNITED STATES PATENTS

| | | | |
|---|---|---|---|
| 1,793,398 | 2/1931 | Hamberger | 313/115 |
| 2,020,130 | 11/1935 | Astor | 313/114 X |
| 2,912,610 | 11/1959 | Verbeek | 313/117 X |
| 3,569,693 | 3/1971 | Lindae et al. | 313/113 X |

FOREIGN PATENTS OR APPLICATIONS

| | | | |
|---|---|---|---|
| 629,492 | 12/1961 | Italy | 313/115 |
| 192,694 | 11/1967 | U.S.S.R. | 313/115 |

*Primary Examiner*—Siegfried H. Grimm
*Attorney, Agent, or Firm*—Frank R. Trifari

[57] ABSTRACT

The invention relates to a headlight as well as an incandescent lamp which is suitable for being arranged in a reflector by means of which an anti-dazzle beam is produced. For that purpose the headlight and the incandescent lamp comprise a filament and a cap of which two edges extend along the filament. The distance from at least one of the edges to the longitudinal axis of the filament at the area of the end of the filament which is remote from the rear end of the reflector is larger than in any other place along the axis of the filament.

8 Claims, 9 Drawing Figures

HEADLIGHT AND INCANDESCENT LAMP FOR ANTI-DAZZLE BEAM

The invention relates to the problems which present themselves in realizing an anti-dazzle beam for a vehicle.

It is known that such an anti-dazzle beam can be realized by a headlight which comprises a reflector formed as a paraboloid of revolution within which reflector a helically wound filament extending parallel to the reflector axis is arranged, said filament being partly surrounded by a cap of which two edges are present in planes which comprise the axis of the filament. On its front the reflector is sealed by a cover glass. The filament of said heatlight may form part of an incandescent lamp, for example, a halogen incandescent lamp. In addition to the filament for the anti-dazzle beam, said incandescent lamp may comprise a filament for the driving light. Furthermore, embodiments of such incandescent lamps are known in which the cap is arranged inside the lamp envelope, while in still other types the cap is present on the outer wall of the lamp envelope. Each of said incandescent lamps, in the greatest variety of constructions, may form a unit with a reflector so that a so-called sealed-beam headlight is obtained but they may also be constructed as exchangeable lamps which can be mounted in a reflector.

The cap in said known headlights and incandescent lamps is present below and beside the filament for the anti-dazzle beam and thus prevents light rays from the filament to be reflected by the lower side of the reflector so that dazzling of oncoming traffic is prevented. The edges of the said cap extend parallel to the axial direction of the filament and are thus present in planes through the longitudinal axis of the filament. At least one of the cap edges is present in a horizontal plane through the axis of the reflector. The other cap edge is preferably present in a plane which extends through the axis of the reflector and encloses an angle of approximately 15° with the horizontal, so that the parts of the verge which is present above the horizontal and adjoins the lane on which the vehicle is driving is illuminated by the anti-dazzle beam.

In modern traffic, it is desired for an anti-dazzle beam of a vehicle to have a light intensity which is as large as possible at a distance which is as far as possible in front of the vehicle without the oncoming traffic being dazzled. The result of this is that it is endeavoured to have a large gradient in the light intensity distribution, that is to say a sharp bright-dark boundary, of at least that part of the anti-dazzle beam which is directed towards the lane for the oncoming traffic.

It is an object of the invention to indicate in what manner an anti-dazzle beam can be obtained having a very sharp bright-dark boundary.

A first embodiment of the invention is realized in a headlight, in particular suitable for vehicles, which headlight comprises a reflector formed as a paraboloid of revolution within which a helically wound filament for an anti-dazzle beam is arranged parallel to the reflector axis. The filament is partly surrounded by a cap of which two edges are present in planes which intersect to define as their intersection the axis of the filament. The headlight according to the invention is characterized in that the distance from at least one of the edges of the cap to the axis of the filament, measured in the plane which passes through the end of the filament remote from the rear end of the reflector and which extends transversely to the axis of the filament, is larger than the distance from the edge of the cap to the axis of the filament measured in each of the planes which extend transversely to the axis of the filament and are present between the said plane and the rear end of the reflector.

The favourable influence of this shape of the cap edge on the sharpness of the bright-dark boundary may be explained as follows with reference to FIGS. l, 2, 3, 4, 5 and 6 of the drawing, in which FIG. 1 is the horizontal cross-sectional view through the reflector axis of a known headlight, FIG. 2 is a cross-sectional view taken on the line II—II of FIG. 1.

Figure 1:
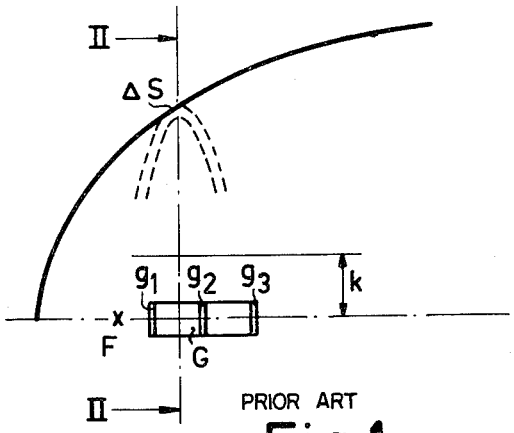
PRIOR ART Fig.1
Figure 2:
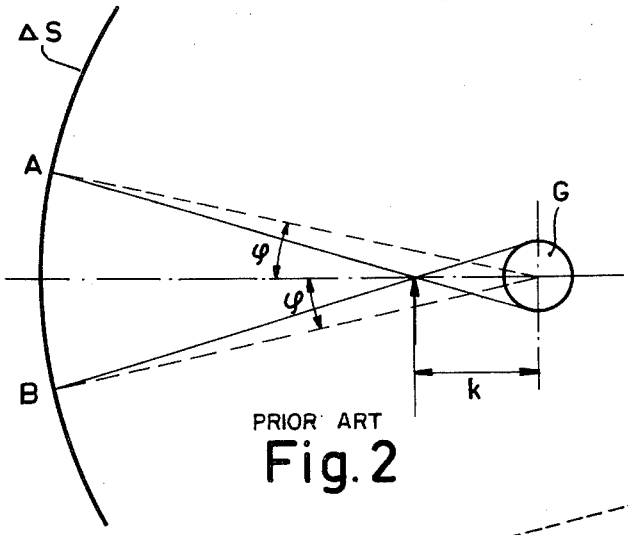
PRIOR ART Fig. 2
Figure 3:
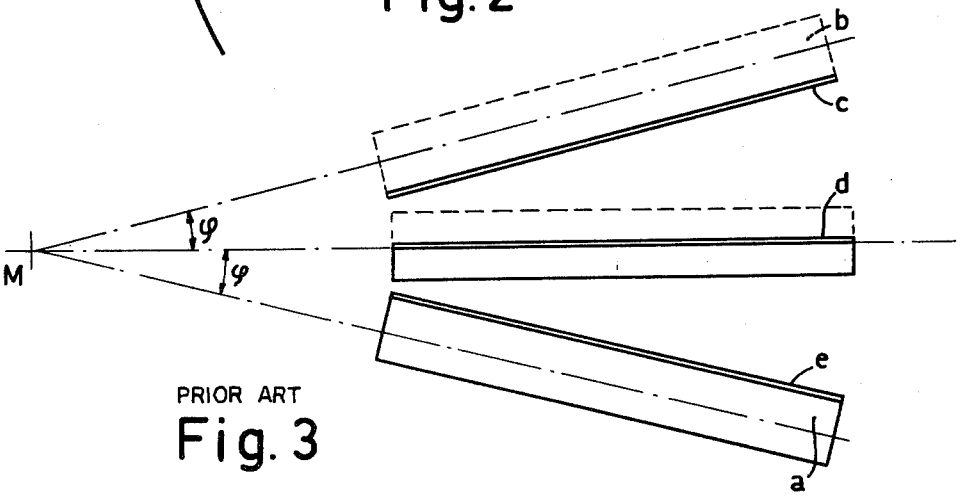
PRIOR ART Fig. 3
FIG. 3 shows the image of the filament by an annular reflector element Δ S on a screen arranged normal to the axis of the filament of and before the head-light of FIGS. 1 and 2.

The filament in FIG. 1 is denoted by G and the distance from the cap edge to the reflector axis by *k*. As is obvious from FIG. 2, the filament is still just visible entirely from the point A of the annular reflector element Δ S, whereas from point B the filament is just screened entirely by the cap. From all the points between A and B only a part of the filament is visible. The image of the filament is produced or reproduced by the point A on the screen placed opposite to the headlight under an angle $\phi$ . (See also FIG. 3). This reproduction is denoted by *a*. The imaginary, broken-line reproduction formed by point B of the filament is denoted by *b* in FIG. 3. This imaginary reproduction also enlcoses an angle $\phi$ with the horizontal. In FIG. 3, M is the center of the screen which is defined by the intersection between the screen and the axis of the filament. The filament and the reflector are of course coaxial. The points between A and B make reproductions of the filament which, taken from A to B are screened increasingly by the cap edge. The cap edge reproductions are shown in FIG. 3 by double solid lines and are denoted by the letters *c*, *d* and *e*.

The sharpness of the bright-dark boundary, if only the contribution of the annular element Δ S is considered, is determined in this headlight by the width of the region between the cap edge reproductions *c* and *e*. The sharpness of the bright-dark boundary would of course be optimum if the reproduction *a* of the filament would adjoin the imaginary reproduction *b* of the filament, that is to say if the cap edge reproductions *c* and *e* would coincide.

The present invention teaches that the sharpness of the bright-dark boundary can be improved by choosing a cap edge shape other than the known shape which extends parallel to the reflector axis.

Figure 4:
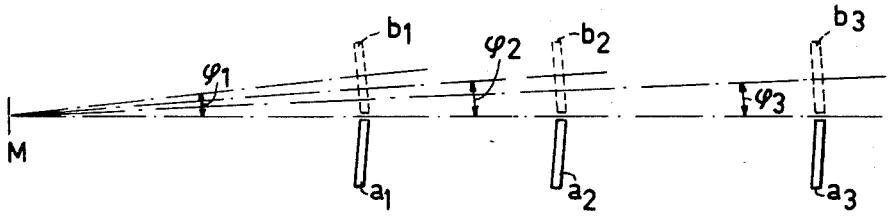
FIG. 4 shows the reproductions of segments of the filament on the screen in the case of optimum sharpness of the bright-dark boundary.
Figure 5:
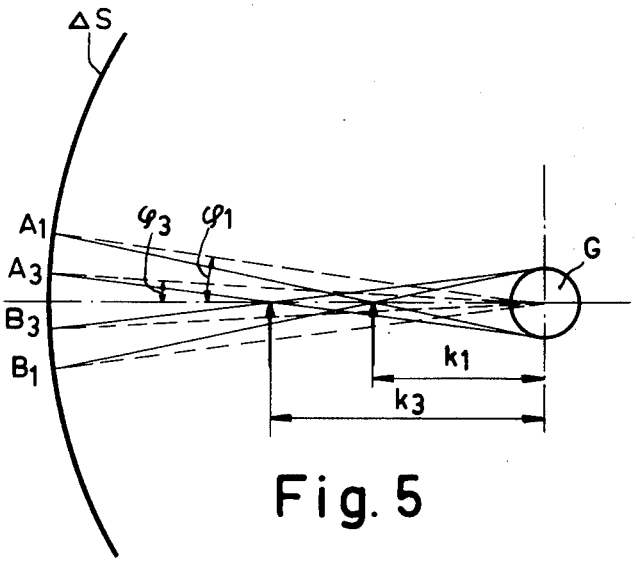
FIG. 5 is the cross-sectional view through the reflector along the reflector element Δ S.
Figure 6:
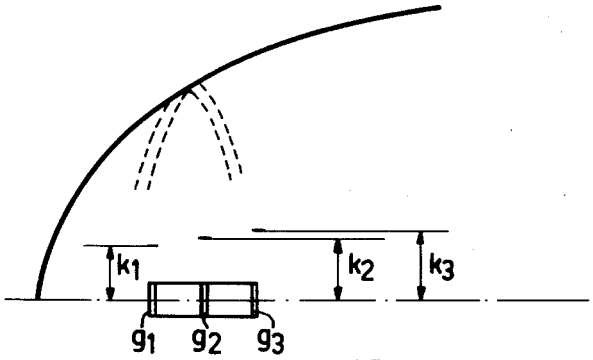
FIG. 6 is the horizontal cross-sectional view through the reflector axis of a headlight.

FIG. 4 shows the reproductions $a_1$, $a_2$, $a_3$ and the imaginary reproductions $b_1$, $b_2$ and $b_3$ of the segments $g_1$, $g_2$ and $g_3$ of the filament in a position in which the cap edge reproductions coincide substantially entirely. These reproductions of the filament segments enclose the angles $\phi_1$, $\phi_2$ and $\phi_3$, respectively, with the horizontal. The angles $\phi_1$ and $\phi_3$ are shown in the drawing of the cross-sectional view of the reflector shown in FIG. 3 from which it is obvious that $a_1$ and $a_3$ are reproduced by the points $a_1$ and $a_3$ of the reflector segment $\Delta$ S. $b_1$ and $b_3$ are reproduced imaginarily by the points $B_1$ and $B_3$. The tangents at the filament drawn through said points $a_1$, $a_3$, $b_1$ and $b_3$ determine the cap edge distances $k_1$ and $k_3$ for which the reproductions of the filament segments $g_1$ and $g_3$ through the reflector element $\Delta$ S shown an optimum sharp bright-dark boundary. FIG. 6 shows the cap edge distances $k_1$, $k_2$ and $k_3$. The most optimum cap edge distance for the reflector element $\Delta$ S thus increases from segment $g_1$ to segment $g_3$.

Of course, again other optimum cap edge distances are found for other annular reflector elements because on the screen the width and the distance from the filament segment reproduction to the center M of the screen depend upon the radius of the annular element considered. Measurements have proved, however, that a cap edge shape in which the distance from the cap edge to the axis of the filament is largest at the area of the end of the filament remote from the top of the reflector, yields a sharper bright-dark boundary than the known cap edge shape. The cap is preferably shaped so that at least one of the edges of the cap shows a curved shape whose centers of curvature are situated on the side of the cap edge remote from the filament.

A favourable embodiment of the headlight according to the invention is characterized in that, measured in planes perpendicular to the longitudinal axis of the filament, the distance from the axis of the filament to the edge of the cap at the area of the end of the filament remote from the rear end of the reflector is at least 0.8 and at most 1.7 times the length of the filament, the smallest distance from the axis of the filament to the cap edge being at least 0.4 and at most 1.2 times the length of the filament. Measured in a plane perpendicular to the longitudinal axis of the filament the distance from the axis of the filament to the cap edge at the area of the end of the filament facing the rear end of the reflector preferably is at least 0.6 and at most 1.5 times the length of the filament.

It has been found that the sharpest bright-dark boundary is obtained when said cap edge distances are maintained.

A further favourable embodiment of the headlight according to the invention is characterized in that the cap comprises one or more parts extending in the direction of the edge of the reflector, with which parts the cap is secured to the reflector. Of course, this embodiment is useful only when the headlight comprises only a filament for the anti-dazzle beam. According to a favourable embodiment the filament is arranged inside the lamp envelope of an incandescent lamp, preferably a halogen incandescent lamp.

A second embodiment of the invention is realized in an electric incandescent lamp, preferably a halogen incandescent lamp sealed by at least one pinch and suitable for being incorporated in a reflector which is in the form of a paraboloid of revolution, which incandescent lamp comprises a filament which is arranged inside a lamp envelope and extends coaxially with the lamp axis and a cap surrounding said filament partly, two edges of said cap being situated in planes which comprise the longitudinal axis of the filament, which incandescent lamp is characterized according to the invention in that the distance from at least one of the edges of the cap to the axis of the filament, measured in the plane which comprises the end of the filament remote from the pinch seal and which extends transversely to the axis of the filament, is larger than the distance from the edge of the cap to the axis of the filament measured in each of the planes which extend transversely to the axis of the filament and are situated between the said plane and the said pinch seal. The inventive idea underlying the invention is, of course, the same as that which has led to the above-mentioned headlight. The achieved effect and the explanation for it are also the same. The electric incandescent lamp according to the invention, however, is particularly suitable for vehicles which are equipped with reflectors having exchangeable incandescent lamps, or with so-called halogen sealed-beam lamps.

A favourable embodiment of the electric incandescent lamp according to the invention is characterized in that at least one of the edges of the cap shows a curved shape whose centers of curvature are situated on the side of the cap edge remote from the filament.

A further favourable embodiment of the incandescent lamp according to the invention is characterized in that, measured in planes perpendicular to the longitudinal axis of the filament, the distance from the axis of the filament to the cap at the area of the end of the filament remote from the pinch seal is at least 0.8 and at most 1.7 times the length of the filament, the smallest distance from the axis of the filament to the cap edge being at least 0.4 and at most 1.2 times the length of the filament. Measured in a plane perpendicular to the longitudinal axis of the filament, the distance from the axis of the filament to the cap edge at the area of the end of the filament facing the pinch seal is preferably at least 0.6 and at most 1.5 times the length of the filament.

Another favourable embodiment of the incandescent lamp according to the invention is characterized in that the incandescent lamp is formed as a twin halogen incandescent lamp, the cap being arranged inside the lamp envelope.

According to still another favourable embodiment of the incandescent lamp according to the invention, the incandescent lamp is in the form of a halogen incandescent lamp, the cap being formed as a black layer which is present on the outer wall of the lamp envelope. The lamp envelope has a shape which is the same as the shape of the cap.

This reflector may be manufactured in known manner, for example, from glass having provided thereon a reflecting layer or a reflecting metal. A filament 3 for an anti-dazzle beam extends coaxially with the reflector axis 2. The filament 3 is connected to two current supply wires 4 and 5 which are connected in known manner, via the rear end 6 of the reflector, to external contact members not shown. The filament, viewed from the rear end 6, is present beyond the focus of the parabolic reflector 1.

The filament is partly surrounded by a cap which is denoted by 7. The edges 8 and 9 of said cap each lie in a plane which comprises the axis of the filament. The plane in which the cap edge 8 is present is horizontal, while in this embodiment the plane in which the cap edge 9 is present encloses an angle of 15° with the horizontal. As a result of this, objects which are present above the horizontal and on the right in front of the vehicle are illuminated by the anti-dazzle beam. The cap 7 furthermore comprises a front wall 10 and a rear wall 11, as well as two parts 12 and 13 which extend in the direction of the edge 14 of the reflector. The parts 12 and 13 are secured to the reflector edge 14 in a manner not shown. The filament 3 may be arranged inside the lamp envelope of an incandescent lamp which is shown in broken lines and is denoted by 15. In that case, said incandescent lamp preferably is a halogen incandescent lamp.

In this embodiment of the headlight according to the invention, both cap edges 8 and 9 have a curved shape. The centers of curvature of each of the said curves lie on the sides of the cap edges remote from the filament. Of course, in order to obtain a sharp bright-dark boundary of the anti-dazzle beam on that side which faces the oncoming right-hand traffic, the curved shape of cap edge 9 is not necessary. The distance from point A of cap edge 8 to the axis of the filament in this embodiment is 1.2 times the length of the filament, while the smallest distance from the cap edge 8 to the axis of the filament is 0.6 times the length of the filament. The distance from point B to the axis of the filament is 0.8 times the length of the filament. The points A and B are situated in planes which extend transversely to the longitudinal axis of the filament and which each comprise one end of the filament.

Figure 8:
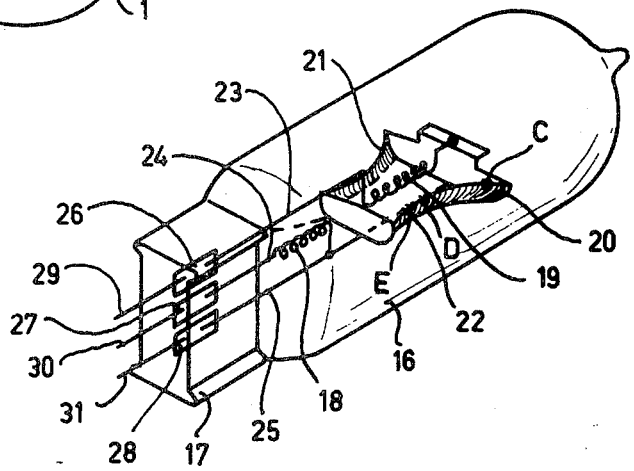
FIG. 8 shows an isometric projection of a twin halogen lamp according to the invention having a cap arranged inside the lamp envelope.

The twin halogen incandescent lamp shown in FIG. 8 comprises a tubular lamp envelope 16 which is sealed on one side by a pinch 17. A filament 18 for the driving beam and a filament 19 for the anti-dazzle beam are arranged inside the lamp envelope. Filament 19 is partly surrounded by a cap 20 whose cap edges 21 and 22 show a curved shape. The distance from the points C, D and E of cap edge 22 to the axis of the filament 19 are 1.0, 0.5 and 0.6 times, respectively, the length of the filament 19. The filaments 18 and 19 and the cap 20 are supported by the current supply members 23, 24 and 25 which are connected to the external contact members 29, 30 and 31 by means of foils 26, 27 and 28 sealed in the pinch seal 17. Said incandescent lamp may be provided with a mounting ring secured to the pinch seal and by means of which the incandescent lamp can be arranged inside a reflector. The incandescent lamp may be exchangeable but it is also possible to mount said incandescent lamp in a reflector so as not be exchangeable, so that a so-called "halogen sealed beam" headlight is obtained.

Figure 9:
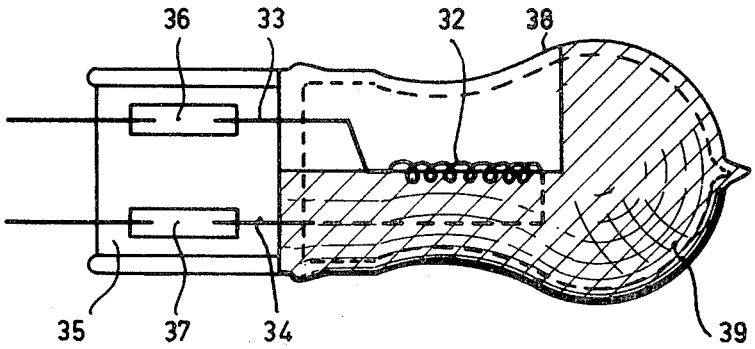
FIG. 9 shows an isometric projection of halogen incandescent lamp according to the invention having a cap provided on the outer wall of the lamp envelope.

The electric incandescent lamp shown in FIG. 9 is a halogen incandescent lamp having a filament 32 for the anti-dazzle beam, current supply wires 33 and 34, pinch seal 35 with sealed foils 36 and 37, and lamp envelope 38. A part of the lamp envelope denoted by 39 has a black layer on its outer surface which serves as a cap. On its part of its circumference present beside the filament the lamp envelope shows a curved shape with which the shape of the cap edge of course corresponds. Said incandescent lamp together with a parabolic reflector provides a very sharp bright-dark boundary. This incandescent lamp also may be used for a sealed beam headlight or be constructed as an exchangeable lamp.

What is claimed is:

1. A lamp which comprises a reflector formed as a paraboloid of revolution within which a helically wound filament for a beam is disposed with the axis thereof parallel to the reflector axis, a cap disposed about a radial sector of said filament, said cap having first and second curvilinear edges, said edges lying in the first and second planes, said first and second planes intersecting at the axis of said filament, the distance from at least one of the edges of the cap to the axis of the filament measured in a first plane which passes through the end of the filament remote from the rear end of the reflector and which extends transversely to the axis of the filament, is larger than the distance from the edge of the cap to the axis of the filament measured in any other plane which extends transversely to the axis of the filament and is disposed between said first plane and the rear end of the reflector, at least one of the edges of the cap has a curved shape whose centers of curvature are situated on the side of the cap edge remote from the filament.

2. A lamp as in claim 1 wherein said lamp is an automobile headlamp.

3. A lamp as in claim 1 wherein said lamp is a twin halogen incandescent lamp.

4. A lamp as in claim 1 wherein said lamp is a halogen incandescent lamp, the cap being a black layer disposed on the outer wall of the lamp envelope.

5. A lamp as claimed in claim 1 wherein measured in planes perpendicular to the longitudinal axis of the filament, the distance from the axis of the filament to the edge of the cap at the area of the end of the filament remote from the rear end of the reflector is at least 0.8 and at most 1.7 times the length of the filament, the smaller distance from the axis of the filament to the cap edge being at least 0.4 and at most 1.2 times the length of the filament.

6. A lamp as claimed in claim 5, wherein measured in a plane perpendicular to the longitudinal axis of the filament, the distance from the axis of the filament to the cap edge at the area of the end of the filament facing the rear end of the reflector is at least 0.6 and at most 1.5 times the length of the filament.

7. A lamp as claimed in claim 6, wherein said cap has one or more parts extending in the direction of the edge of the reflector, with which parts the cap is secured to the reflector.

8. A lamp as claimed in claim 7, wherein said filament is disposed inside the lamp envelope of a halogen incandescent lamp.

* * * * *

UNITED STATES PATENT AND TRADEMARK OFFICE

CERTIFICATE OF CORRECTION

PATENT NO. : 3979622

DATED : September 7, 1976

INVENTOR(S) : Johannes Rijnders et al

It is certified that error appears in the above-identified patent and that said Letters Patent are hereby corrected as shown below:

Column 3, line 11, "3" should be --5--.

Figure 7:
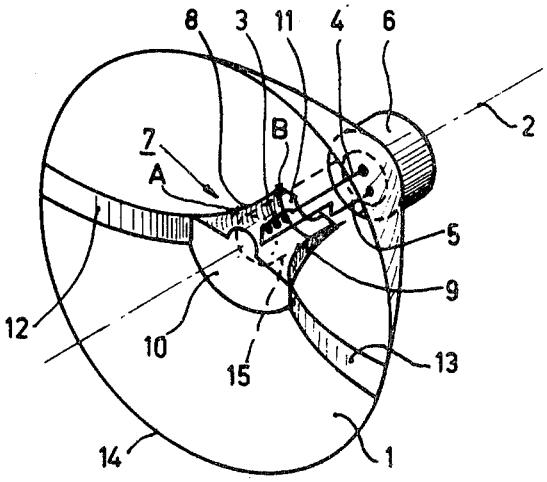
FIG. 7 shows an isometric projection of a headlight according to the invention.

Column 4, line 56, insert as the first sentence of the paragraph --The headlight shown in Figure 7 comprises a reflector 1 in the form of a paraboloid of revolution.--

Signed and Sealed this

Eighteenth Day of January 1977

[SEAL]

*Attest:*

RUTH C. MASON
*Attesting Officer*

C. MARSHALL DANN
*Commissioner of Patents and Trademarks*